United States Patent [19]

Schwartz et al.

[11] 4,032,811

[45] June 28, 1977

[54] UNITIZED IN-LINE ELECTRON GUN HAVING IMPROVED SUPPORT STRUCTURE

[75] Inventors: James W. Schwartz, Deerfield; Norman F. Gioia, Lombard; Franklyn P. Gautier, Oak Park, all of Ill.

[73] Assignee: Zenith Radio Corporation, Glenview, Ill.

[22] Filed: Dec. 18, 1975

[21] Appl. No.: 642,049

[52] U.S. Cl. ..... 313/417; 313/456

[51] Int. Cl.[2] ..... H01J 29/51

[58] Field of Search ..... 313/412 AB, 414, 417, 313/451, 456

[56] References Cited

UNITED STATES PATENTS

| | | | |
|---|---|---|---|
| 3,659,133 | 4/1972 | Tsuneta et al. | 313/417 |
| 3,935,498 | 1/1976 | Doggett et al. | 313/417 |

*Primary Examiner*—Rudolph V. Rolinec
*Assistant Examiner*—Lawrence J. Dahl
*Attorney, Agent, or Firm*—John H. Coult

[57] ABSTRACT

This disclosure depicts and describes a unitized, in-line electron gun for television cathode ray tubes having a bead-type structure for mechanically supporting, spacing, and aligning gun components. This disclosure is particularly directed to an improved structure which promotes a greater stability of electrode support with a reduced tendency toward bead fracture.

6 Claims, 4 Drawing Figures

UNITIZED IN-LINE ELECTRON GUN HAVING IMPROVED SUPPORT STRUCTURE

CROSS REFERENCES TO RELATED APPLICATIONS

This application is related to but in no way dependent upon, copending applications of common ownership herewith, including Ser. No. 494,123, filed Aug. 2, 1974; and Ser. No. 666,858 filed Mar. 15, 1976 a continuation-in-part of the said application Ser. No. 494,123.

BACKGROUND OF THE INVENTION

This invention relates generally to an improved unitized, in-line electron gun for color cathode ray tubes, and more specifically, to the secure mounting and alignment of the electrodes of such guns, and to the enhanced utility of the mounting structures.

The unitized, in-line electron gun generates three co-planar electron beams developed by the thermionic emission of heated cathodes arranged in line. The resulting beams are formed and spaced by a tandem succession of electrodes spaced along the central axis of the gun. The electrodes cause the beams to converge at multiple phosphor groups located on the faceplate of the color cathode ray tube. The prime objective in the design of such guns is to provide small spot size and enhanced resolution. To accomplish this objective, the electron gun electrodes and their field-forming surfaces must be as nearly as possible accurately positioned in exact parallelism, exact spacing, and in exact concentricity in relation to each other as a stable and coherent unit immune as far as is practicable from displacement due to shock, vibration, handling during production, thermal heating, or other causes.

The most common method of mounting electron gun electrodes is the process of embedding extensions of the metal parts of the gun electrodes, commonly called "claws," into one or more structural members extending in a direction parallel to the electron beam axis of the gun. These structural members, or "beads," (also called "pillars" or "multiform beads") are typically made of glass. The beads provide support; proper positioning, spacing and concentricity; and electrical isolation for the several gun electrodes. It is common practice to embed the electrode holding claws in the center line of the structural bead, and to use a narrow bead not much wider than the claws themselves. As a result of the embedding process, stress is often created in the material of the bead at the point of claw insertion. Also, as a result of mechanical, thermal, or other stress, hairline cracks often occur in the bead, following a flaw line extending across the narrowest cross-section of the bead itself. This condition is apt to result in complete fracture of the bead and destruction of the utility of the entire gun assembly. Also, such stress-induced cracks, even if minor at first, may eventually spread and result in paths for destructive electrical arcing and/or degradation of gun performance resulting from shifting or other misalignment of gun parts after installation in the cathode ray tube.

Another common deficiency of the presently used structural bead is one that, while not so obvious as a catastrophic fracture of the bead material, may exert a deleterious but more subtle effect on gun performance. This statement applies especially to unitized, in-line type electron guns, and concerns the establishment and maintenance of critical dimensional spacing between gun electrodes, the concentricity of the apertures of beam forming electrodes, and the maintenance of parallelism between the facings of the electrodes. This problem is exacerbated by the close spacing required between the electrodes, and by the fact that in in-line, unitized gun structures, each common electrode is as wide as the aggregate width of three individual electrodes in an in-line, non-unitized gun. (As used herein, the "width" dimension of an electrode is its dimension in the plane passing through the central axis of the beams and orthogonal to the gun's central axis). The gaps between electrodes must be small enough to provide good stray field isolation and proper beam-forming fields. A typical example is disclosed in Hughes U.S. Pat. No. 3,873,879: the control and screen grid electrodes, whose claws are embedded in two narrow glass beads, are spaced 0.009 inch (0.225 mm) apart. Another example: In the unitized, in-line gun that is the subject of the present invention, the following exemplary specifications with regard to spacing, concentricity, and parallelism of the electrodes apply. The spacing between grids one and two is 0.008 inch ±0.0007 (0.20 mm ±0.017); spacing between other grids is 0.040 inch ±0.0015 (1.01 mm ±0.038). Concentricity tolerances between grids one, two, and three are 0.0005 inch (0.0127 mm); between grids four, five and six, ±0.001 inch (0.025 mm). Parallelism tolerance between grids one and two is ±0.0008 inch (0.020 mm); between other grids, ±0.0015 inch (0.038 mm).

It is obvious that any spatial displacement in any direction, or any tilting (or "wedging") of the electrodes one to the other due to unsound mounting and retention of the electrodes can result in deleterious changes in the critical spacings and precise co-axial alignments that are so necessary to ensure proper gun performance, both for the short term and for the entire operating lifetime of the gun.

The tendency of electrodes of in-line, unitized gun structures to move, tilt or wedge and so lose proper spacing, aperture concentricity, and parallelism can be attributed in general to the present mechanical design of such electrodes. In the present state of the art, it is customary to use single claws on opposite sides of each gun electrode, with the claws each embedded in the center of glass beads. The resulting abbreviated base line of support of the single claw leaves the electrodes susceptible to shifting or skewing under mechanical or other stress, with consequent degradation of gun performance.

A present common method of mounting the electrodes of an in-line gun is shown in the afore-mentioned Hughes U.S. Pat. No. 3,873,879, wherein two beads located on opposite sides of the gun, and narrow in relation to the gun electrodes, provide for the mechanical support, spacing, alignment and concentricity of the electrodes. The relative narrowness of the beads in relation to the dimensions of the electrodes is shown by reference number 23 of FIG. 8 of the subject patent, and the narrowness and close spacing of the embedded electrodes is shown also by other figures in the disclosure. In gun structures supported by two narrow beads the gun assembly is subject to torsional or twisting stress so that any quantum of parallel misalignment of the two supporting bead members is amplified by a "scissoring" effect. As a result, components located more distantly from the pivot point of the scissors, are subject to an even greater displacement, especially with regard to aperture concentricity.

U.S. Pat. No. 3,239,078 issued to Johnson discloses an electrode mounting system especially for small, single-beam electron gun assemblies. Quoting Johnson (Column 2, lines 32–36):"the salient feature of this invention reside in a strap mounted on a beam-forming electrode such as a grid or focus anode and having two laterally positioned prongs for connection into a single rod located parallel to the beam." The Johnson electrode mounting means described would not appear to be suitable for application to unitized, in-line guns with their critical tolerance requirements. Neither would the Johnson electrode support system appear to be adaptable to unitization, a serious drawback in today's cost-conscious market.

U.S. Pat. No. 3,622,831 issued to Blumenberg describes a bead for a single gun used in a miniaturized indicia tube. This patent discloses the use of a single claw which spans the bead and engages it at the edge and central regions. The bead, although wide by single-gun standards, is relatively narrow and susceptible to fracture because of the establishment of a potential fracture line (stress concentration) across the entire width of the bead. The Blumenberg claw design in this case would not be desirable in the supporting of electrodes in a unitized, in-line electron gun.

Attempts have been made to resolve some of the problems inherent in the beading of in-line, non-unitized guns by provision of an integral beading structure on each side of the gun which is common to all three guns. U.S. Pat. No. 3,816,789 discloses in one embodiment a beading structure comprising two relatively narrow bead components, interconnected by a bridging member to support and space the electrodes. Claws on the discrete gun electrodes are embedded in the relatively narrow bead components and in the bridging member. A structure of this type suffers from the described tendencies to fracture, and in addition, due to the narrow region of embedment of the claw relative to the width of the electrodes, the electrodes are apt to move or skew relative to one another due to the flexing of the single metallic support pillars pressed into each bead. A second embodiment disclosed in this patent includes a narrow central bead with integral outstretched arms which, together with the central bead, hold the discrete gun electrodes. This embodiment is plagued with the problems inherent in the described first embodiment.

It is one aspect of this present invention to ameliorate the problems described in the foregoing prior art examples by setting forth means to enhance fracture resistance of beads while at the same time increasing the strength of the beads in resisting the forces of torsion and deflection. It is another aspect to provide means to enhance resistance to forces that can skew or misalign the bead-supported electrodes in spatial relationship one to the other.

OBJECTS OF THE INVENTION

It is a general object of this invention to obviate the shortcomings of the prior art expressed in the foregoing by providing a bead-type electrode support for unitized, in-line guns having improved resistance to fracture, and providing greater stability, precision and mechanical strength in the spacing and alignment of the gun components.

It is a less general objective to provide a bead-type gun electrode supporting structure having a unique form factor that serves to provide valuable ancillary functions related to electron gun performance and operation.

BRIEF DESCRIPTION OF THE DRAWINGS

The features of the invention which are believed to be novel are set forth with particularity in the appended claims. The invention, together with further objects and advantages thereof, may be best understood, however, by reference to the following description taken in conjunction with the accompanying drawings, in the several figures of which like reference numerals identify like elements, and in which:

DESCRIPTION OF THE PREFERRED EMBODIMENTS

Figure 1:
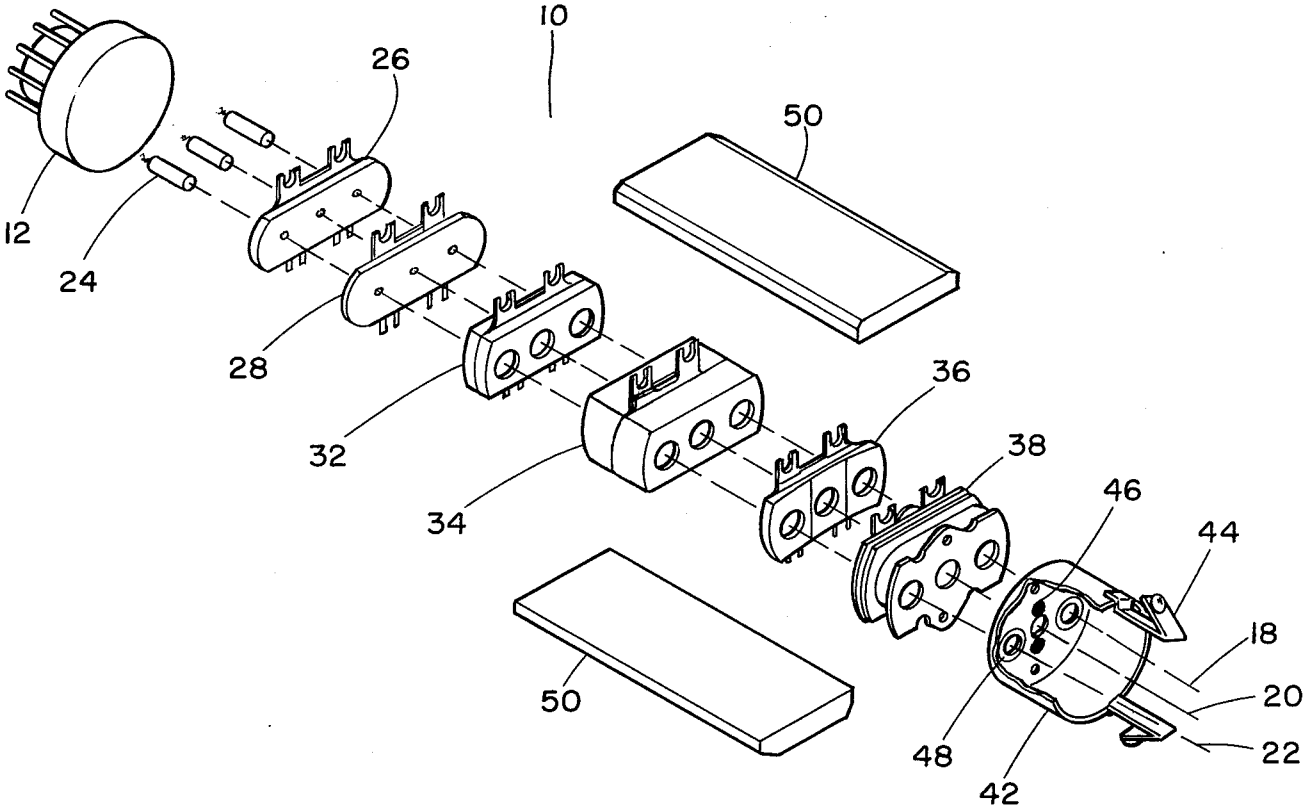
FIG. 1 is an exploded view in perspective of the elements of a color cathode ray tube unitized, in-line gun constructed and structurally supported in accordance with this invention.

This invention relates generally to an improved unitized, in-line electron gun for color television cathode ray tubes, and more specifically, to the secure mounting and proper spacing, and the more secure alignment of the parts of such guns, and to the enhanced utility of the mounting structures.

The unitized, in-line gun described in this invention offers many advantages over other types in common use for color cathode ray tubes such as the delta-cluster gun. The cost advantages of in-line gun striped screen tubes, especially in terms of savings in convergence hardware, circuitry and implementing set-up labor are well known. The advantages of unitization of gun structures are also well known. A few of these advantages include: The gun has fewer parts; the "unitizing" of the control grid and accelerating grid results in fewer leads and circuits: convergence is simplified so that a typical number of 12 convergence adjustments required for the delta-gun tube has been reduced to two or three in the in-line system; and when the in-line gun is adapted to the 110° deflection tube, the depth of the cathode ray tube is shortened by nearly 4 inches, while the beam travels a shorter distance resulting in smaller spot size and enhanced resolution.

But these many advantages are partially offset by problems in fabricating the in-line, unitized gun, with the problems being primarily of a mechanical nature. The delta-gun structure, being of a triangular configuration, is inherently more stable than three guns assembled in a line, and the in-line guns are more difficult to align initially and hold in alignment permanently. Problems have arisen in the production of in-line guns as a consequence—problems which the several aspects of the invention described herein are designed to resolve. The standard production assembly procedure is to hold the subassemblies of the gun in proper relationship to each other by means of mechanical fixtures, then fasten all parts together by pressing a heat-softened bead of glass onto the claws which form an integral part of each gun part. Two beads are normally used, one on each side. Upon cooling of the bead and removal of the fixtures, the claws are embedded in the glass bead, and the gun parts are more or less permanently affixed in proper spatial relationship to each other, depending upon the stability and mechanical integrity of the beaded structure.

Production practice has shown this procedure to be less than ideal, primarily because of the physical characteristics of the beads. Embedding the claws in the center line of a narrow bead of glass results in many rejections due to cracking of the beads upon cooling, or during subsequent spot-knocking (high voltage conditioning). If cracks occur, the entire gun must be discarded even though it has reached the final stage of production and has accrued nearly all of its production cost. But even if catastrophic cracking does not occur at this stage, the parts of the gun cannot be entirely relied upon to remain in proper spatial relationship or alignment as fixtured because the narrow support base provided by the present inadequate bead-claw system configuration allows the grid elements to skew during the cooling cycle after beading due to asymmetrical imperfections.

The present invention offers means to reduce the incidence of expensive gun rejects during the final stages of production, and means to establish and hold all parts of the gun permanently in proper spatial relationship and alignment as a coherent structure.

One aspect of the invention is realized in two elongated axially oriented structural beads positioned on opposite sides of the gun electrodes; that is, on sides opposite to the beam plane. Each bead is characterized by a central, axially-extending section which is free from embedment of the holding claws of several of the gun electrodes, and therefore more uniformly stressed, whereby the beads are less prone to fracture at points of claw embedment. To establish this central uniform and mechanically strong section, the width of each bead is designed to span at least one-half the maximum width of each gun electrode.

A second aspect of this invention concerns the electrode claws, at least one pair of which is located on each side of the electrodes. Each claw of each pair is relatively narrow and is widely spaced from its opposite in the pair to provide a wide-stance baseline to resist moments of torsional force which can result in electrode skewing, wedging or tilting. The resulting stability of this wide baseline of claw embedment more effectively promotes the maintenance of exact parallelism, exact spacing, and exact concentricity of each electrode with all other electrodes of the electron gun. In accordance with the preferred execution, the spacing between each pair of claws is equal to at least one-half the maximum width of the electrode of which the claws are an integral part.

Another embodiment shows the bead designed to support a structure that provides a function ancillary to tube operation. The beam-focusing electrodes of the electron gun may require at least three different electrical voltage potentials for proper beam shaping and focusing. One or both of the beads is designed with a longitudinal recess on the outer face to support a voltage divider structure useful in supplying proper electrical potentials to the electrodes that lie immediately beneath the bead.

Figure 2:
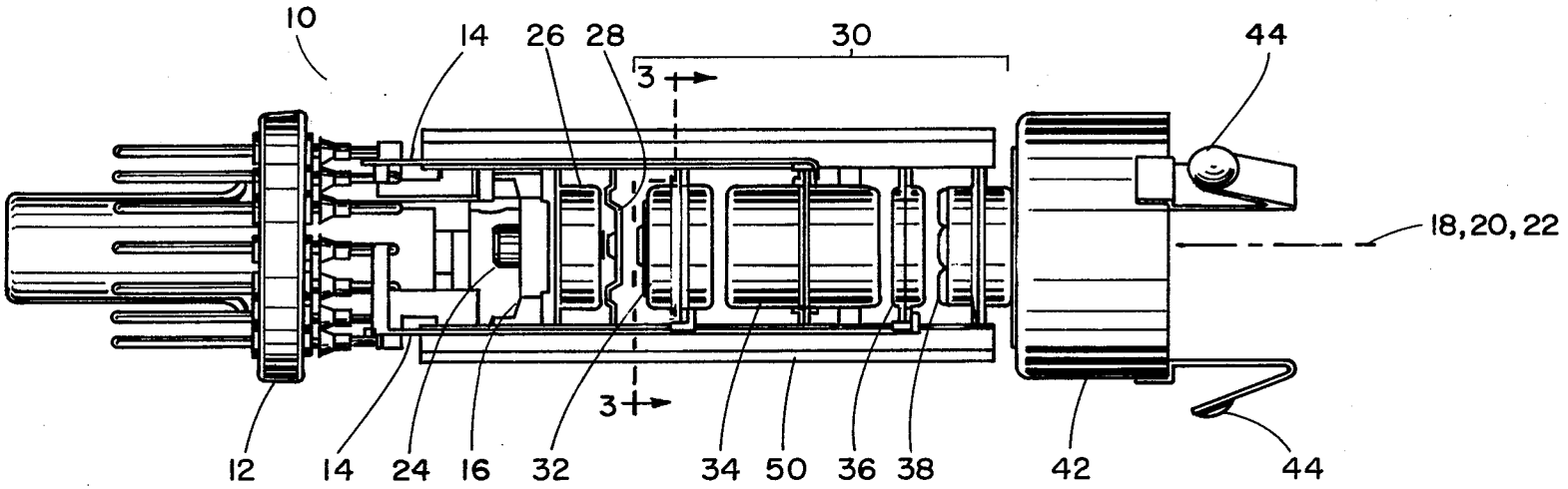
FIG. 2 is an assembled side view of the gun shown in FIG. 1.
Figure 3:
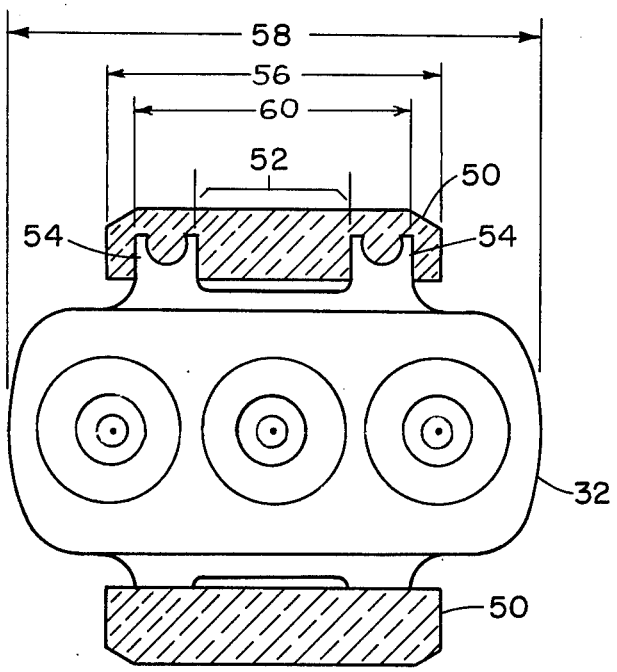
FIG. 3 is a sectional view taken along lines 3—3 of FIG. 2.

Whereas the invention can be embodied in several different structures, a preferred embodiment is illustrated in FIGS. 1–3. FIG. 1 is an exploded view in perspective of a unitized, in-line electron gun 10 for use in a color television cathode and FIG. 2 is an assembled side view of the subject gun. As is well known in the art, such a gun structure for a cathode ray tube is commonly located at the base of the cathode ray tube in the narrow neck region opposite the faceplate. The electron gun 10 generates three co-planar electron beams, each of which is formed, shaped and directed to selectively energize phosphor elements located on the imaging screen in the expanded area at the opposite end of the cathode ray tube envelope.

Referring to FIGS. 1 and 2, an air-tight cathode ray tube base 12 provides a plurality of electrical leads for introducing into the glass envelope the video and blanking signals as well as certain voltage potentials for beam forming and focusing. The operating signals and voltages are conveyed to the several electrodes and grids of the gun 10 within the glass envelope by means of several internal electrical leads, two typical ones of which are shown by 14. The three electron-emitting cathodes 24 of the heater-cathode assembly 16, generate three co-planar beams of electrons 18, 20 and 22 which energize the red, green and blue phosphors respectively and in proper sequence on the imaging surface of the television cathode ray tube through a multi-apertured color selection electrode (not shown). The three beams are generated by three cathodes 24 having the form of cups coated with a common thermionic-emissive compound. Within each cup is an electrically resistive wire element energized to cause it to heat the cathode cup of each gun to an approximate temperature of 1050° K. The heated thermionic-emissive compound yields a stream of electrons which pass through the apertures of common control grid 26, forming the electron beams into an essentially circular cross-section. The beams thus generated travel through a series of focusing electrodes to impinge on the phosphor screen.

Referring again to FIG. 1, unitized, disc-type accelerating grid 28 follows control grid 26 in the progression of the three electron beams from the cathodes 24 to the imaging screen. Accelerating grid 28 is at a higher potential than control grid 26, and it serves the primary purpose of providing the initial accelerating impulse to the three electron beams.

As an indication of the criticality of the accuracy of spacing between grids 26 and 28, the spacing may be for example, 0.008 inch ±0.0007 (0.203 mm ±0.017), and the parallelism between grids 26 and 28 may be held to a tolerance of ±0.0008 inch (0.020 mm). The aperture diameters of accelerating grid 28 are identical in size to those of the control grid 26. The two grids serve an additional function of collimating the three streams of electrons to form very small, essentially round in cross section beams. As is characteristic of the unitized electron gun, the three elements of control grid 26 are formed as a single metallic unit having the same voltage potential, and are connected to the external luminance control circuit of the television chassis by a single lead through base 12. The three accelerating elements of accelerating grid 28 are similarly formed as an integral unit and energized by a common electrical voltage potential. This combining or "unitizing" of the control grid 26 and accelerating grid 28 results in fewer leads and circuits in the television set to control the functions of grids 26 and 28.

After receiving the accelerating impulse of grid 28, the three beams enter the electrostatic fields of the beam focusing lens 30, consisting of unitized electrodes 32, 34, 36, and 38. Each electrode in lens 30 carries a predetermined and constant voltage to establish a beam focusing field, or an "electrostatic lens" for each beam. This type of lens, also referred to as an "extended field lens," utilizes the principles of the extended field lens described and claimed in U.S. Pat. No. 3,895,253 by Schwartz et al.

Referring again to electron lens 30 of FIG. 2, the focusing lens electrodes 32, 34, 36 and 38 contain an integral in-line series of three small cylindrical apertures, each of which is in exact alignment with electron beams 18, 20 and 22 generated by the three cathodes 24. Each of the electrode cylinders 32, 34, 36 and 38 are physically separated from each other to establish the focusing fields of the electron lens.

The difference in potential between adjacent focusing electrodes 32, 34, 36 and 38 establishes a series of focusing fields capable of shaping a stream of electrons flowing through the fields, according to the principles of electron optics. In the in-line, unitized gun that is the subject of this invention, the potentials between electrodes 32, 34, 36 and 38 may for example have an axial potential distribution which varies monotonically from a relatively intermediate potential at electrode 32, to a relatively low potential at electrode 34, and varies again monotonically to a relatively intermediate potential on 36, to a relatively high potential at electrode 38. In one execution, the voltage potential of electrode 32 may be 12 kV, electrode 34 may be about 6 kV, electrode 36 may be 12 kV, and electrode 38 may be 30 kV. The higher potential of electrode 38 is taken directly from the ultor voltage source through the snubber springs 44. This axial potential distribution is the subject of the referent copending application Ser. No. 494,123. The low and intermediate voltages have their origin in power supplies external to the tube, with leads brought in through the base 12 and with internal distribution through leads 14.

Further shaping, directing and focusing of the electron beam is accomplished between electrodes 36 and 38, the configuration of which constitutes two separate electron lens components for converging the outer two beams 18 and 22 inwardly to a common point of combination with central beam 20 which does not vary from a direct axial path. The convergence of beams 18 and 22 towards center beam 20 is accomplished by a slight inward bias cut of the two electrode faces of the two outer beam apertures of electrode 36, and a parallel, matching bias cut on the facing members of electrode 38. (The bias-cut cylinder concept does not constitute per se, an aspect of this invention but is described and claimed in co-pending application Ser. No. 666,858 filed Mar. 15, 1976.

The last in the series of elements that comprise electron beam gun 10 is the convergence assembly 42. Convergence assembly 42 serves primarily as a mounting base for the three snubber springs 44 which in turn hold the forward end of the gun firmly centered in the neck of the cathode ray tube. Also, through contact with the electrically conductive coating on the inside of the neck of the tube, snubber springs 44 convey the high voltage potential to electrode 38. Located within the cup formed by the convergence assembly, and adjacent to the aperture ports from which the three electron beams 18, 20 and 22 emerge are the magnetic enhancers 46 and magnetic shunts 48.

The foregoing description provides general background for the understanding of the invention and the objects thereof. In the following, the several aspects of the bead and electrode claw members that supply structural support for the unitized, in-line gun are described in detail.

It is a critical characteristic of the united, in-line electron gun that all gun electrodes must be positioned in exact and precise spatial relationship and alignment one with all others, and that this relationship and alignment must be integrated into a configuration that will maintain the entire gun as a stable and coherent unit immune insofar as possible to torsional and deflectional stress resulting from the handling during assembly, testing, and mounting within the neck of the cathode ray tube; also, from the results of shock, vibration, and thermal expansion and contraction while in situ. In the unitized, in-line gun that is the subject of the present invention, the preferred embodiment of this invention that brings about this desired structural integrity lies in the form factor of the two identically shaped axially oriented beads 50 positioned on opposite sides of the gun electrodes; that is, on opposite sides of the beam plane. Referring now to FIG. 3, electrode 32 is shown in a partially cross-sectional end view in conjunction with the beads 50, and with electrode mounting claws 54 embedded in beads 50. In accordance with one aspect of this invention, due to the provision of wide beads and widely spaced points of claw embedment in the beads, there is established in the beads a central, axially extending section 52 which is free from embedment of electrode claws and thereby uniformly stressed and mechanically sound, and wherein the bead 50 has a diminished tendency towards transverse fracture from stress cracks which may emanate from the points of claw embedment.

The tendency towards transverse fracture of the bead is further inhibited in this embodiment by the configuration of the electrode claws, which are formed from a single thickness of metal. It is common practice in the prior art to form each half of an electrode cup by a drawing process, and to form the electrode claws on the flange of each cup by diecutting. The facing halves of each pair of cups are then spot-welded together, with the result that each claw commonly consists of a double thickness of metal captivated at one end by a spot weld, with each part thereof free to flex away from the other part. The embedment of this double thickness of claw metal exacerbated by the capability of the parts to flex increases the tendency towards bead fracture, especially when the claw is embedded in a narrow bead structure and in close proximity of embedment to another claw of similar design. The pair of beads 50 have a wide-stance baseline 56 which spans at least one-half the maximum width 58 of electrode 32. One pair of claws 54 is positioned on each side of each electrode with the electrodes having a total of four claws, two on each side. The claws of each pair on each side of each electrode are relatively narrow, and are spaced apart a span distance 60 that is preferably equal to at least one-half the maximum width 58 of electrode 32. The wide spacing of each of the two pairs of claws integral with the electrodes make possible the embedment of the claws at widely spaced points in the glass beads 50, thereby ensuring the lateral stability of the electrodes, and promoting the establishment and maintenance of exact parallelism and exact spacing between adjacent electrodes, and exact concentricity of the electrode apertures. In conjunction, the widely spaced relatively narrow claws permit the creation of the central, axially extending uniformly stressed mechanically strong region 52 in each of the two glass beads 50 that structurally support the electron gun 10.

Figure 4:
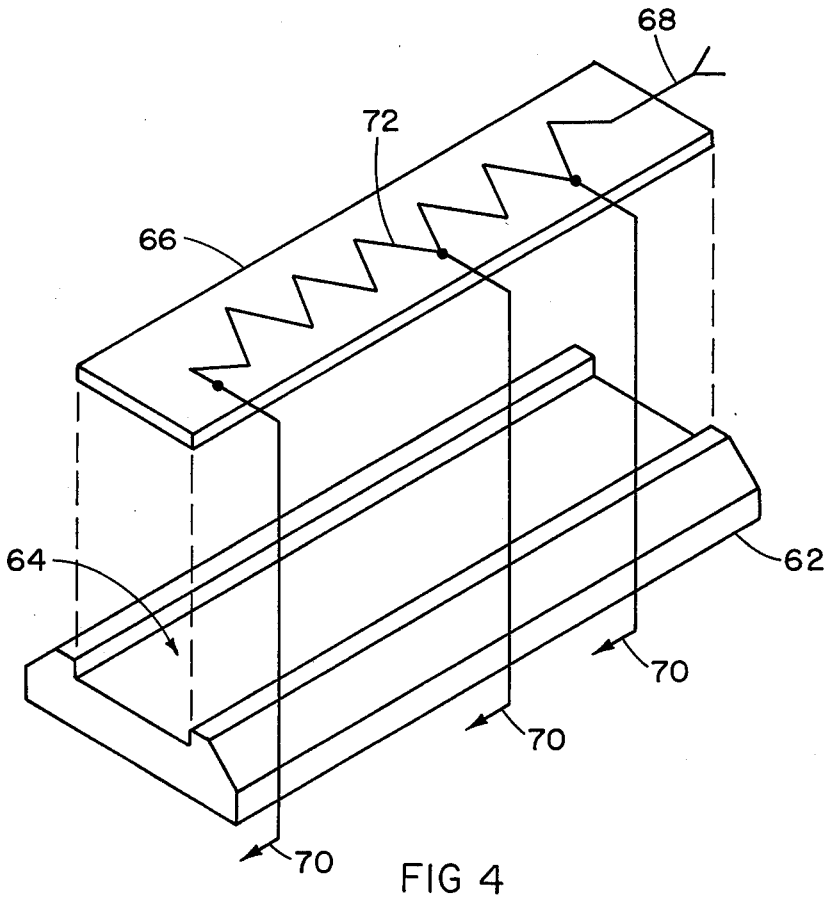
FIG. 4 is an isometric view of an alternative bead structure.

Another feature is shown by the alternative configuration of the structural bead 62 shown in FIG. 4. The configuration of bead 62, while identical in all other respects in physical shape, composition and purpose to bead 50 already described, is characterized by the presence of a longitudinal recess 64 for supporting a voltage divider structure 66. Voltage divider structure 66 provides a plurality of electrical potentials for the electrodes of electron gun 10 that require such a plurality for electron beam forming and focusing. Voltage divider structure 66 resolves the problem of introducing multiple discrete high voltage potentials through the closely spaced leads in the cathode ray tube neck without also introducing a tendency toward destructive arcing between leads. Voltage divider structure 66 is located within the tube envelope where it can receive the initial high voltage potential through input lead 68, as by means of a short interconnecting lead to convergence assembly 42 which is electrically energized at the ultor voltage potential. The close and sequential proximity of the voltage divider structure to the succession of gun electrodes makes it feasible to supply the underlying electrodes 30 of gun 10 through short, convenient electrical connections 70 that are routed directly to the electrodes that lie beneath the beads that structurally support them.

Despite the addition of the recess 64 in the bead 62, the central axially extending section 52, while reduced in thickness, remains free from embedment of electrode claws or electrical leads from the voltage divider structure, and the section remains uniformly stressed and with relatively unaffected structural strength, and with adequate area for claw embedment without the initiation of fractures because of too-close spacing of points of embedment.

With regard to the insulative properties of bead 50 and the alternate structural bead with recess 62, the dimensions of bead 50 in the illustrated preferred embodiment are 1.866 inches in length by 0.560 inch in width by 0.125 inch deep (47.396 mm L by 14.22 mm W by 3.17 mm D). The addition of the voltage divider structure recess 64 (refer to FIG. 4) reduces the depth of the bead in the recess area by 0.035 inch (0.875 mm). The insulative properties of the bead (Corning Glass Company Multiform Glass, Corning Code No. 7761) is specified at 3,000 volts/mil minimum on the average, thus providing an adequate insulative barrier between voltage divider structure 66 and the underlying electrodes 30.

Referring to FIG. 3, the exemplary dimensions with regard to electrode 32 and mounting claws 54 are for example: width of claw 54 is 0.100 inch (2.54 mm), span distance 60 of claws 54 is 0.464 inch (11.78 mm), and width 58 of electrode 32 is 0.870 inch (22.098 mm).

Other changes may be made in the above-described apparatus without departing from the true spirit and scope of the invention herein involved, and it is intended that the subject matter in the above depiction shall be interpreted as illustrative and not in a limiting sense.

We claim:

1. For use in a color television cathode ray tube, a unitized, in-line electron gun; that is, a gun generating three co-planar electron beams and having beam-forming and beam-shaping electrodes common to the three beams, said electrodes being supported as a coherent unit in spaced tandem succession along the gun's central axis by claws on the electrodes embedded in two elongated axially oriented structural beads positioned on opposite sides of the electrodes; that is, on opposite sides of the beam plane, at least one of said electrodes having on each side thereof at least one pair of widely spaced, relatively narrow claws integrally formed with the electrode, and lying respectively in planes transverse to the gun axis, with said claws embedded at widely spaced points on the glass bead to enhance the lateral stability of the electrodes, once embedded in the beads, to promote the establishment and maintenance of parallelism, precise spacing, and aperture concentricity of adjacent ones of said electrodes.

2. An electron gun as described in claim 1 wherein said beads each have a width which spans at least one-half the maximum width of said electrodes.

3. For use in a color television cathode ray tube, a unitized, in-line electron gun; that is, a gun generating three co-planar electron beams and having beam-forming and beam-shaping electrodes common to the three beams, said electrodes being supported as a coherent unit in spaced tandem succession along the gun's central axis by claws on the electrodes embedded in two elongated axially oriented structural beads positioned on opposite sides of the electrodes; that is, on opposite sides of the beam plane, said gun being characterized by each of said electrodes having on each side thereof at least one pair of widely spaced, relatively narrow integral claws which lie respectively in planes transverse to the gun axis, said claws in each pair of claws being embedded at widely spaced points in the bead so as to enhance the lateral stability of the electrodes, once embedded in the beads, and thereby enhance the establishment and maintenance of parallelism, precise spacing, and aperture concentricity of adjacent ones of said electrodes; said gun being further characterized by each bead having a central, axially extending section between the claws of said claw pair which is free from embedment of electrode claws and thereby more uniformly stressed and mechanically sound, so that said beads are caused to have a diminished tendency towards transverse fracture.

4. An electron gun as described in claim 3 wherein the span distance of each of said pairs of claws is preferably equal to at least one-half the maximum width of said electrode.

5. For use in a color television cathode ray tube, a unitized, in-line electron gun; that is, a gun generating three co-planar electron beams and having beam-forming and beam-shaping electrodes common to the three beams, said electrodes being supported as a coherent unit in spaced tandem succession along the gun's central axis by claws on the electrodes embedded in two elongated axially oriented structure beads positioned on opposite sides of the electrodes; that is, on opposite sides of the beam plane, said gun having one of said electrodes comprising a disc-type electrode having on each side thereof at least one pair of widely spaced, relatively narrow claws integrally formed with the electrode, and lying in a plane transverse to the tube axis, with said claws embedded at widely spaced points on the glass beads to enhance the lateral stability of the electrode once embedded in the beads, and to promote the establishment and maintenance of parallelism, precise spacing and aperture concentricity of adjacent ones of said electrodes.

6. An electron gun as described in claim 5 wherein the span distance of each of said pairs of claws is preferably equal to at least one-half the maximum width of said disc-type electrode.

* * * * *